US006253684B1

(12) United States Patent
Summa et al.

(10) Patent No.: US 6,253,684 B1
(45) Date of Patent: Jul. 3, 2001

(54) STOP MECHANISM FOR POWER AND FREE CONVEYOR SYSTEM

(75) Inventors: Gareth D. Summa, Kansas City; Andrew L. Meyer, Prairie Village, both of KS (US)

(73) Assignee: Conveyor Technology Group, Inc., Kansas City, KS (US)

( * ) Notice: Subject to any disclaimer, the term of this patent is extended or adjusted under 35 U.S.C. 154(b) by 0 days.

(21) Appl. No.: 09/136,075

(22) Filed: Aug. 18, 1998

(51) Int. Cl.[7] ..... B61B 10/02

(52) U.S. Cl. ..... 104/172.4; 104/172.3; 104/172.5; 104/250; 104/251; 104/172.2

(58) Field of Search ..... 104/172.3, 172.4, 104/172.5, 250, 251, 172.2

(56) References Cited

U.S. PATENT DOCUMENTS

| | | | | |
|---|---|---|---|---|
| 3,648,619 | | 3/1972 | Wilkinson . | |
| 3,696,756 | * | 10/1972 | Elmore et al. | 104/251 |
| 3,995,561 | | 12/1976 | Allor, Jr. . | |
| 4,408,540 | * | 10/1983 | Dehne | 104/172 B |
| 4,483,252 | | 11/1984 | Pierson . | |
| 4,542,698 | | 9/1985 | Wakabayashi . | |
| 4,646,650 | | 3/1987 | Kondo et al. . | |
| 4,760,798 | * | 8/1988 | Blengini | 104/209 |
| 4,811,685 | | 3/1989 | Murai . | |
| 4,898,099 | * | 2/1990 | Summa | 104/172.4 |
| 5,195,437 | | 3/1993 | Wallace et al. . | |
| 5,549,050 | | 8/1996 | Rhodes . | |

* cited by examiner

*Primary Examiner*—S. Joseph Morano
*Assistant Examiner*—Frantz F. Jules
(74) *Attorney, Agent, or Firm*—Hovey, Williams, Timmons & Collins

(57) ABSTRACT

A stop mechanism for detaching a conveyor trolley from a drive system which normally drives the trolley along a conveyor track. A ramp can be moved into the path of a trolley dog so that the trolley dog moves upwardly along an inclined ramp surface to disengage the trolley dog from a drive dog carried by a driven chain of the conveyor system. The actuating mechanism for the ramp includes a pivotal cam plate actuated by a power cylinder. A cam slot in the cam plate receives a cam roller connected with a guide link which moves in a vertical guide slot. The guide link is connected with the ramp to move it up and down under the control of the actuating cylinder.

4 Claims, 7 Drawing Sheets

STOP MECHANISM FOR POWER AND FREE CONVEYOR SYSTEM

FIELD OF THE INVENTION

This invention relates generally to conveyor systems and more particularly to an improved stop mechanism for detaching trolleys from the drive systems of large conveyor systems of the type commonly known as power and free conveyors.

BACKGROUND OF THE INVENTION

Automobile assembly plants and other facilities that require large conveyor systems often make use of power and free conveyors. A power and free conveyor includes a number of trolleys which travel along conveyor tracks and are equipped with carriers on which partially assembled automobile bodies or other articles are transported between successive work stations. The trolleys are normally propelled by a drive chain which travels continuously along a separate track on wheels connected with the chain. The trolley typically has a pivotal arm which includes a trolley dog. The trolley dog is normally engaged by a drive dog that projects from the chain so that the chain conveys the trolley along the conveyor track. In a commonly used conveyor system known as an inverted power and free conveyor, the drive chain is located below the trolley.

A power and free conveyor is advantageous in many applications because the drive chain runs continuously and all of the carriers are conveyed except for those that are selectively detached from the drive chain so that work can be performed on the objects they carry. Thus, some of the carriers can be stopped without the need to stop all of the others.

It is necessary to provide a power and free conveyor with a stop mechanism that is used to selectively disengage the trolleys from the drive chain so that the carrier can be stopped at the desired locations. Also, it is necessary to stop a carrier that is approaching a preceding carrier that is stopped on the track. Devices that perform the latter function and prevent collisions between carriers are known as accumulators. The present invention is concerned instead with a stop mechanism that may be situated at a selected location along the conveyor track and actuated to stop the next coming trolley adjacent to a work station.

Different types of stop mechanism have been proposed, mostly involving the insertion of a blade in the path of the trolley lever to pivot the lever in a direction to detach the trolley dog from the chain dog. Another type of stop is disclosed in U.S. Pat. No. 4,790,247 to Summa. The present invention is an improvement over all of the foregoing types of stop mechanisms.

Although the stops that have been proposed in the past operate in a satisfactory manner, they are not wholly free of problems. Most notably, the ability of prior stop mechanisms to function reliably over an extended operating life is questionable. Each time the stop mechanism is engaged or released, its parts are subjected to considerable wear which can cause a malfunction when the cumulative effective of the wear builds up to the point where the parts no longer cooperate as intended. If the stop mechanism fails, it is necessary to shut the entire conveyor system down long enough to allow the necessary repairs or replacement to be completed. This can create a significant problem because of the combined effect of the lost production and the costs that are involved in repairing or replacing the stop mechanism.

SUMMARY OF THE INVENTION

The present invention is directed to an improved stop mechanism which is specially constructed to function reliably and effectively over a prolonged operating life. In accordance with the invention, a pivotal cam plate is provided with a cam slot in which a cam roller operates. The cam roller is connected into a guide link that is restricted to up and down movement in a guide slot. The cam plate may be pivoted by a power cylinder to cause the cam to travel along the cam slot, and this in turn causes the guide link to move vertically in the guide slot.

The guide link forms part of a linkage between the cam mechanism and a ramp which is moved upwardly and downwardly with the guide link. When the ramp is lowered, it is located below the trolleys and does not effect their movement along the conveyor track. However, when the stop mechanism is actuated, the ramp is raised and then presents an inclined ramp surface in the path of the incoming trolley dog. The trolley dog travels upwardly along the ramp surface and pivots the trolley arm until the trolley dog has been raised far enough to detach from the chain dog. This stops the trolley until the ramp is lowered to allow the trolley dog to drop to a position at which it is engaged by the next incoming chain dog to transport the trolley away.

The use of a pivoting cam plate and cooperating cam and guide slots provides the stop mechanism with a smooth operating cycle which reduces the wear on the parts. At the same time, the ramp moves linearly up and down, so its motion is simple and repeatable. The overall result is a stop mechanism that is reliable, durable, safe, and economical, as well as applicable to both new and existing power and free conveyor systems.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1A:
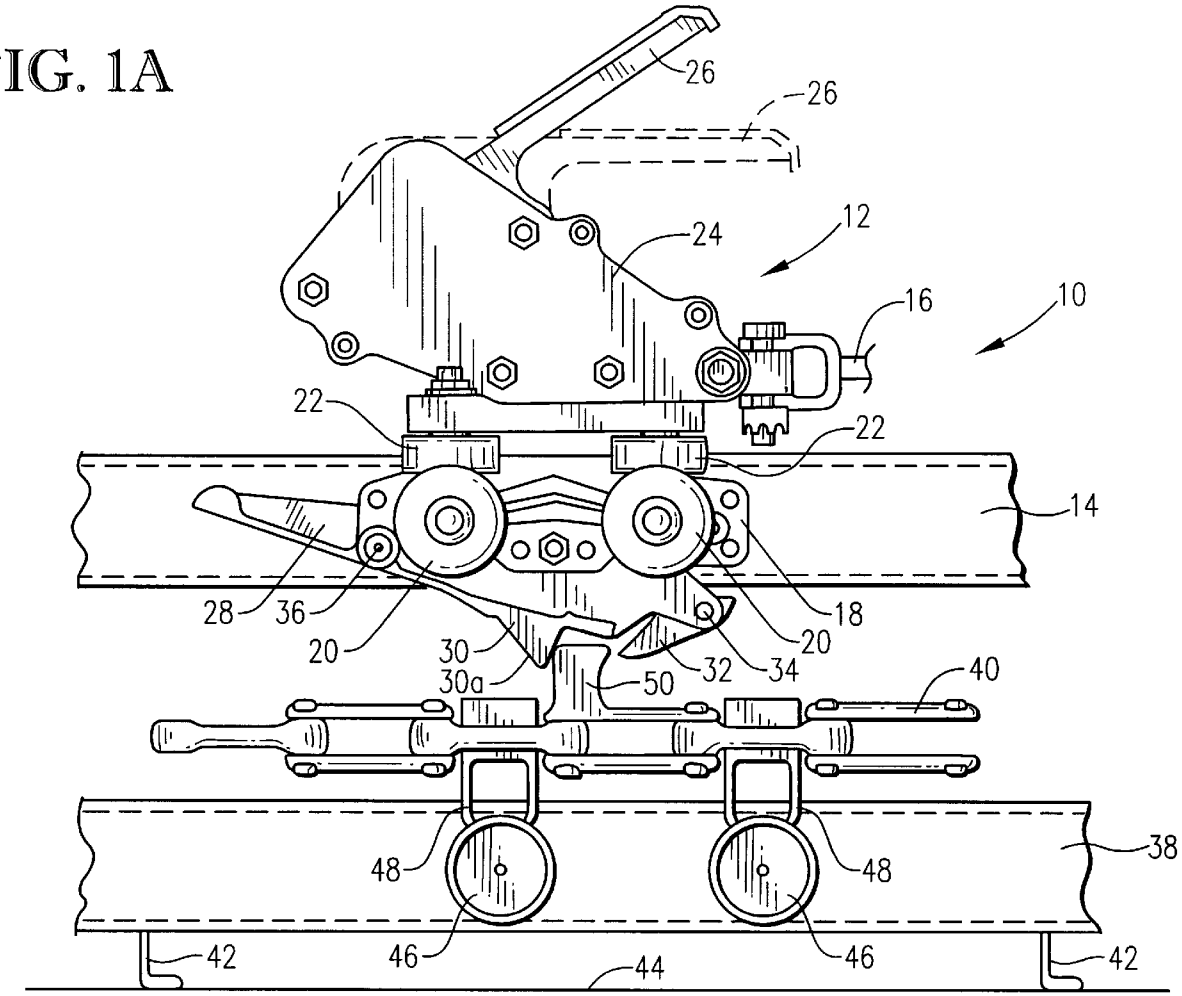
FIG. 1A is a fragmentary side elevational view of a portion of an inverted power and free conveyor system of the type that may be equipped with a stop mechanism constructed in accordance with the present invention.

Referring now to the drawings in more detail and initially to FIG. 1A in particular, numeral 10 generally designates an inverted power and free conveyor of the type commonly used in automobile assembly plants and other applications. The conveyor 10 is used to convey partially completed automobile bodies or other workpieces which are carried on carriers (not shown). The carriers are mounted on a plurality of wheeled trolleys such as the trolley generally identified by numeral 12. The trolleys 12 travel along spaced apart conveyor tracks 14, and the trolleys in each set are connected with one another by a draw bar 16 or similar device. Each carrier is supported on two or more of the trollies 12 and is conveyed with its contents along the conveyor tracks 14 as the trollies travel along the tracks. The leading trolley 12 for each carrier has a rigid body 18 carrying two pairs of wheels 20 that roll along the tracks 14. Guide wheels 22 are mounted on each trolley body 18 to turn about vertical axes to maintain the trolley properly centered on the tracks 14.

The leading trolley for each carrier is provided with an accumulator mechanism which includes a pair of side plates 24 mounted above the trolley body 18 and equipped with an actuating lever 26. The lever 26 is normally in the raised position shown in solid lines in FIG. 1A but can be pivoted downwardly to the broken line position when it engages the carrier of a preceding set of trolleys. This disconnects the trolley 12 from the drive system which normally propels it.

The trolley body 18 is provided with a pivot arm 28 which carries a retractable trolley dog 30 and a pivotal hold back dog 32. The hold back dog 32 is pivotally mounted at 34 to the trailing end of the pivot arm 28. The trolley dog 30 is spaced forwardly from the hold back dog 32 and has an inclined leading surface 30*a*. A horizontal pivot bolt 36 mounts the pivot arm 28 to the trolley body 18 and is located so that the weight of the arm 28 urges its trailing end downwardly.

Another set of tracks 38 are located generally below the conveyor tracks 14 and are used for guiding of a drive chain 40 which is used to transport the trolleys 12 along the conveyor tracks 14. The lower tracks 38 may be mounted on supports 42 which are secured to the floor 44 or another surface of the building in which the conveyor system 10 is installed.

Wheels 46 which travel along the lower track 38 are connected by brackets 48 with the drive chain 40. The chain 40 is equipped with a plurality of spaced apart drive dogs 50 which project upwardly from the chain 40 and are normally received between the trolley dog 30 and the hold back dog 32. In normal operation, the chain drive dog 50 pushes against the back surface of the trolley dog 30 in order to drive the trolley 12 along the conveyor tracks 14. The hold back dog 32 catches on the trailing surface of the drive dog 50 when the trolley 12 is traveling down-hill, thus preventing the trolley from overrunning the drive dog 50.

As thus far described, the conveyor 10 has a conventional construction for the most part. The construction and operation of the conveyor system is illustrated and described more particularly in U.S. Pat. No. 4,790,247 to Summa which is incorporated herein by reference and which may be reviewed for a more detailed explanation of the construction and general operation of the trolley and the conveyor system. When the lever 26 of the accumulator device is pivoted downwardly to the broken line position of FIG. 1A due to engagement with a preceding carrier, the pivot arm 28 is pivoted in a counterclockwise direction as viewed in FIG. 1A to retract the trolley dog 30 upwardly so that it detaches from the drive dog 50, thus stopping the trolley and preventing collisions between carriers.

The present invention is directed to a stop mechanism which may be installed at one or more selected locations along the conveyor system and which functions to stop the trolley 12 at a work station where work can be performed on the workpiece carried on the carrier.

Figure 3A:
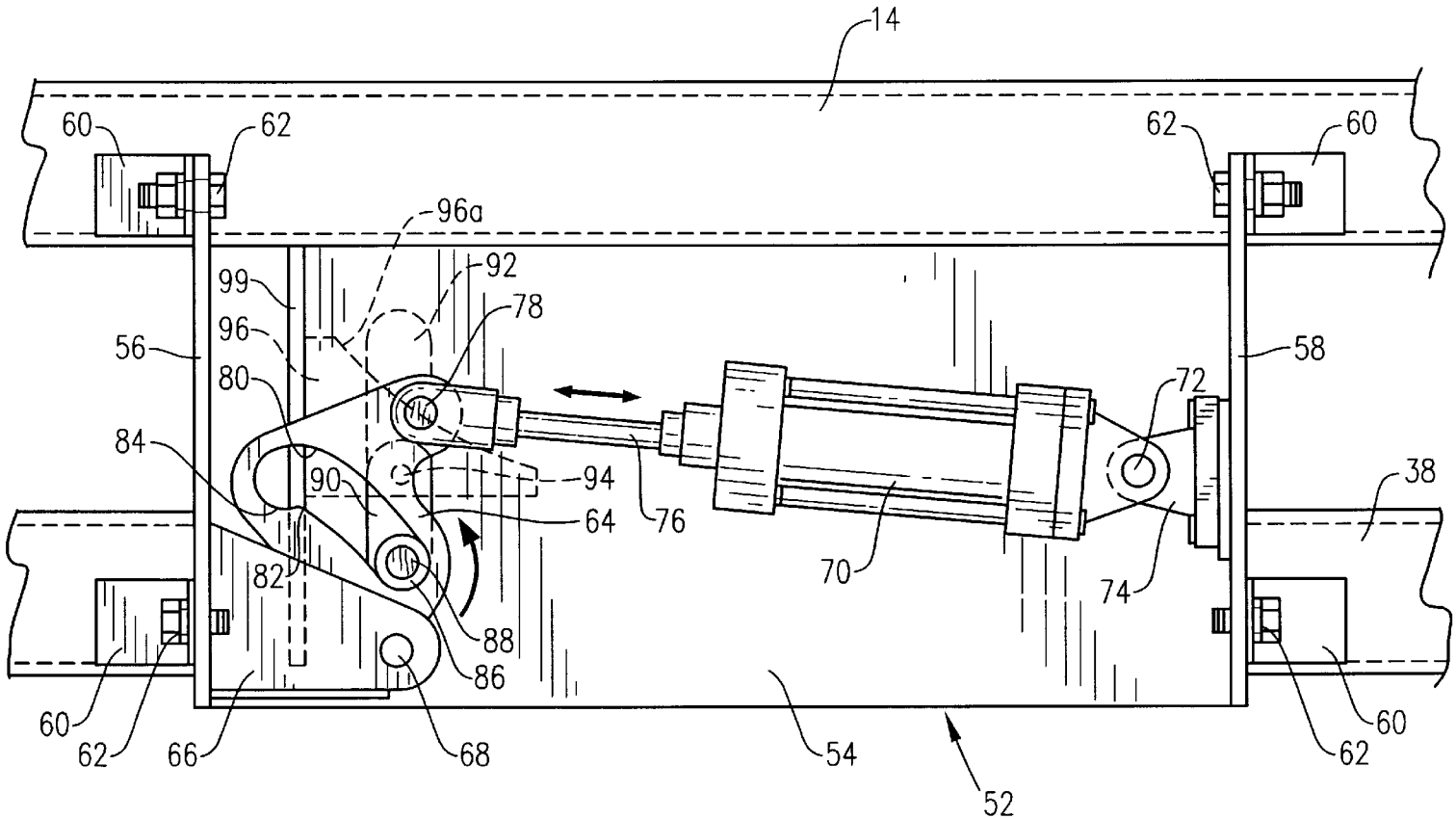
FIG. 3A is a fragmentary side elevational view on an enlarged scale showing the actuating mechanism and ramp included in the stop mechanism of the present invention, with the ramp in its lower position.
Figure 3B:
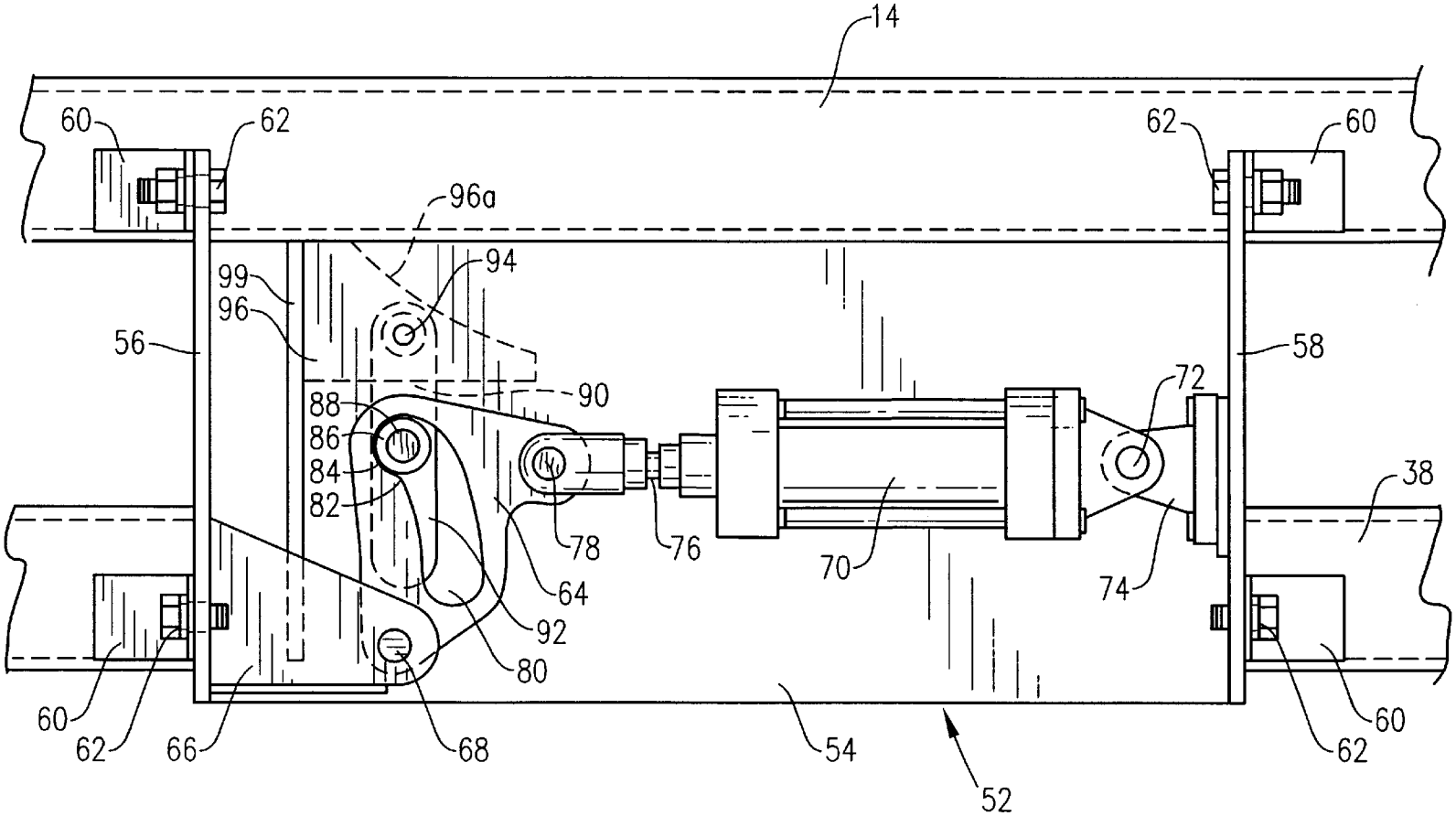
FIG. 3B is a fragmentary elevational view similar to FIG. 3A, but showing the actuating mechanism in its actuated condition to move the ramp to its raised position for detachment of the trolley from the drive chain.
Figure 4:
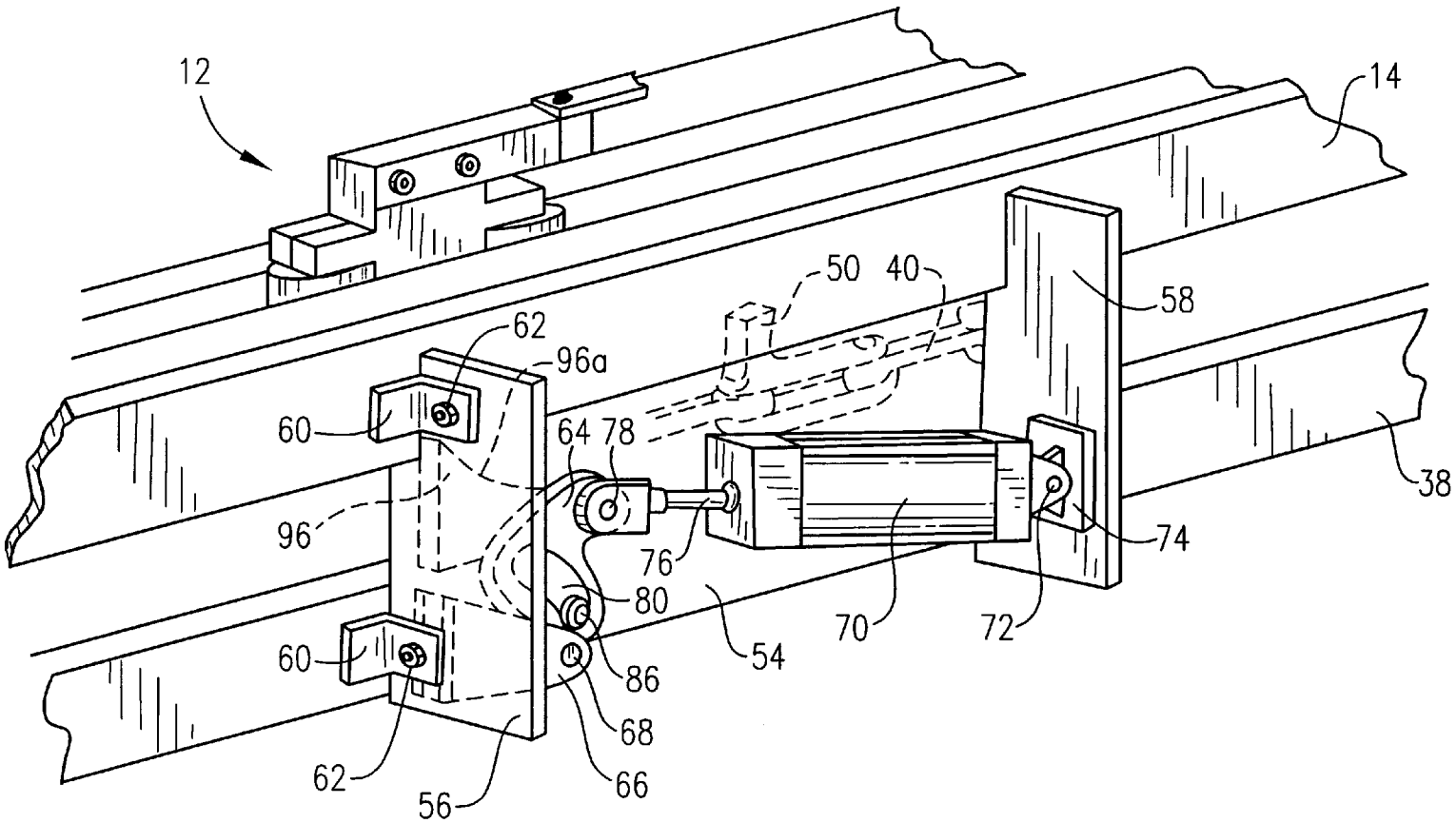
FIG. 4 is a fragmentary perspective view showing the actuating mechanism in a condition where the ramp is in its lowered position.
Figure 5:
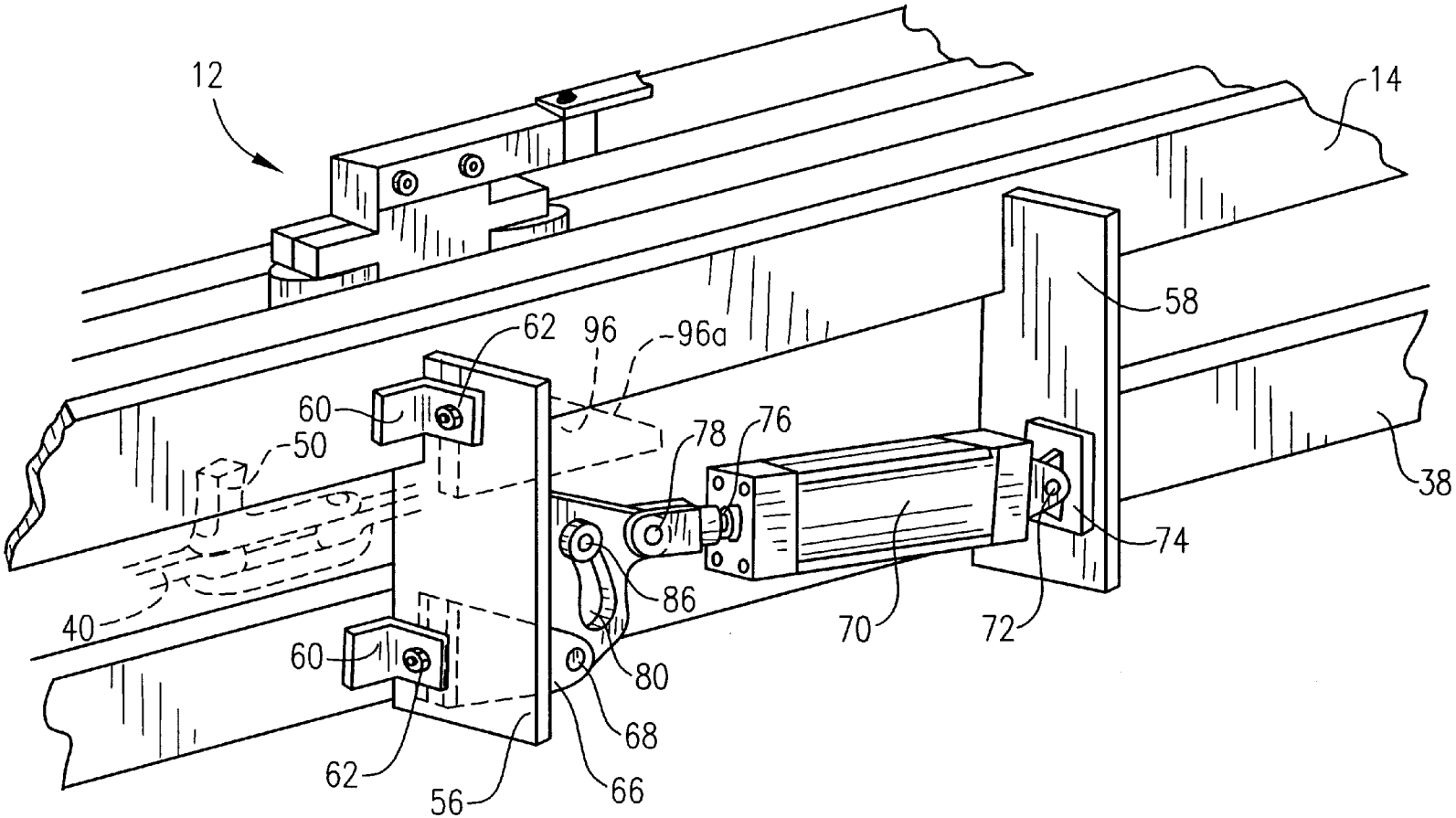
FIG. 5 is a fragmentary perspective view similar to FIG. 4, but showing the actuating mechanism in its actuated condition to move the ramp to its raised position.

Referring now more particularly to FIGS. 3A and 3B, the stop mechanism has a rigid frame which is generally identified by numeral 52 and which includes a flat side plate 54 and opposite end plates 56 and 58 extending from the side plate 54. Brackets 60 are secured to the outside faces of tracks 14 and 38 and are secured to the end plates 56 and 58 by suitable fasteners 62 which mount the frame 52 to the tracks of the conveyor system. The side of the mechanism opposite plate 54 may be covered by a suitable cover plate (not shown).

The stop mechanism has an actuating system which includes a pivotal cam plate 64. The cam plate 64 has an irregular shape that is generally triangular with rounded corner portions. One corner portion of the cam plate 64 is received between a pair of mounting lugs 66 which project from the end plate 56 of the frame. A horizontal pivot pin 68 connects the corner of cam plates 64 to the brackets 66 such that the cam plate can pivot about the horizontal axis provided by the pin 68.

Pivotal movement of the cam plate 64 is effected by a pneumatic cylinder 70 having its base end pinned at 72 to a lug 74 projecting from the end plate 58. The cylinder 70 has a piston rod 76, the end of which is pinned at 78 to another corner area of the cam plate 64. When the rod 76 is fully extended, the cam plate 64 is pivoted about pin 68 to its extreme counterclockwise position which is the position shown in FIG. 3A. Retraction of the rod 76 pivots the cam plate 64 in a clockwise direction about pin 68, and the cam plate is in the position shown in FIG. 3B when the rod 76 is fully retracted.

The cam plate 64 is provided with a cam slot 80 which extends from a bottom end located between the pins 68 and 78 to an upper end portion which is located near the third corner area of the cam plate 64. The opposite edges of the slot 80 are generally parallel to one another. The left edge of slot 80 (as viewed in FIG. 3A) is provided near its top end portion with an inward projection 82 which forms a shoulder 84 adjacent to the projection 82 in the upper end portion of the slot 80. As will be explained more fully, the projection 82 and shoulder 84 serve a locking function for the stop mechanism.

A cam element for the actuating system includes a cam roller 86 which is mounted on a horizontal bolt 88. The cam roller 86 is received in the cam slot 80 and has a diameter to fit closely between the opposite edges of slot 80.

The end of the bolt 88 opposite the end carrying the cam roller 86 is connected with the lower end of a guide link 90. The guide link 90 is closely received in a vertical guide slot 92 formed in the side plate 54 of the frame 52. The link 90 is restricted to vertical movement upwardly and downwardly within the guide slot 92.

The upper end of the link 90 is connected by a horizontal screw 94 with a ramp 96. The ramp 96 has an inclined ramp surface 96*a* which faces an approaching trolley 12 traveling in the forward direction indicated by the directional arrow 98 in FIG. 1B. The ramp 96 is restricted to up and down movement by a key 99 (FIGS. 3A and 3B).

In operation of the conveyor system 10, the pneumatic cylinder 70 is normally maintained with its rod 76 fully extended as shown in FIG. 3A. The cam plate 64 is then in a pivotal position where the lower end of its cam slot 80 is aligned with the lower end of the guide slot 92. Consequently, the cam roller 86 is located in the lower end portion of the cam slot 80 and the guide link 90 is in its lowermost position in the guide slot 92. This locates the ramp 96 in its lowermost position which is the position shown in FIG. 3A. In this position, the ramp 96 is located well below the trolley dog 30 and all other portions of the pivot arm 28. The trolley 12 thus bypasses the ramp 96.

When it is desired to stop one of the carriers at the work station adjacent to the location of the stop mechanism, the cylinder is actuated to retract its rod 76. This pivots the cam plate 64 in a clockwise direction from the position shown in FIG. 3A to the position shown in FIG. 3B. As the cam plate 64 pivots in a clockwise direction, the cam slot 80 moves about the pivot arm 68, and the cam slot 80 comes into alignment with progressively higher portions of the vertical guide slot 92. Because the cam roller 86 is restricted to movement within the cam slot 80 and the guide link 90 is connected with the cam roller 86 and is restricted to movement within the guide slot 92, the cam roller 86 is moved progressively upwardly in the cam slot 80 and the guide link 90 is moved progressively upwardly in the guide slot 92. The ramp 96 is connected with the guide link 90 and moves upwardly with upward movement of the guide link.

Figure 1B:
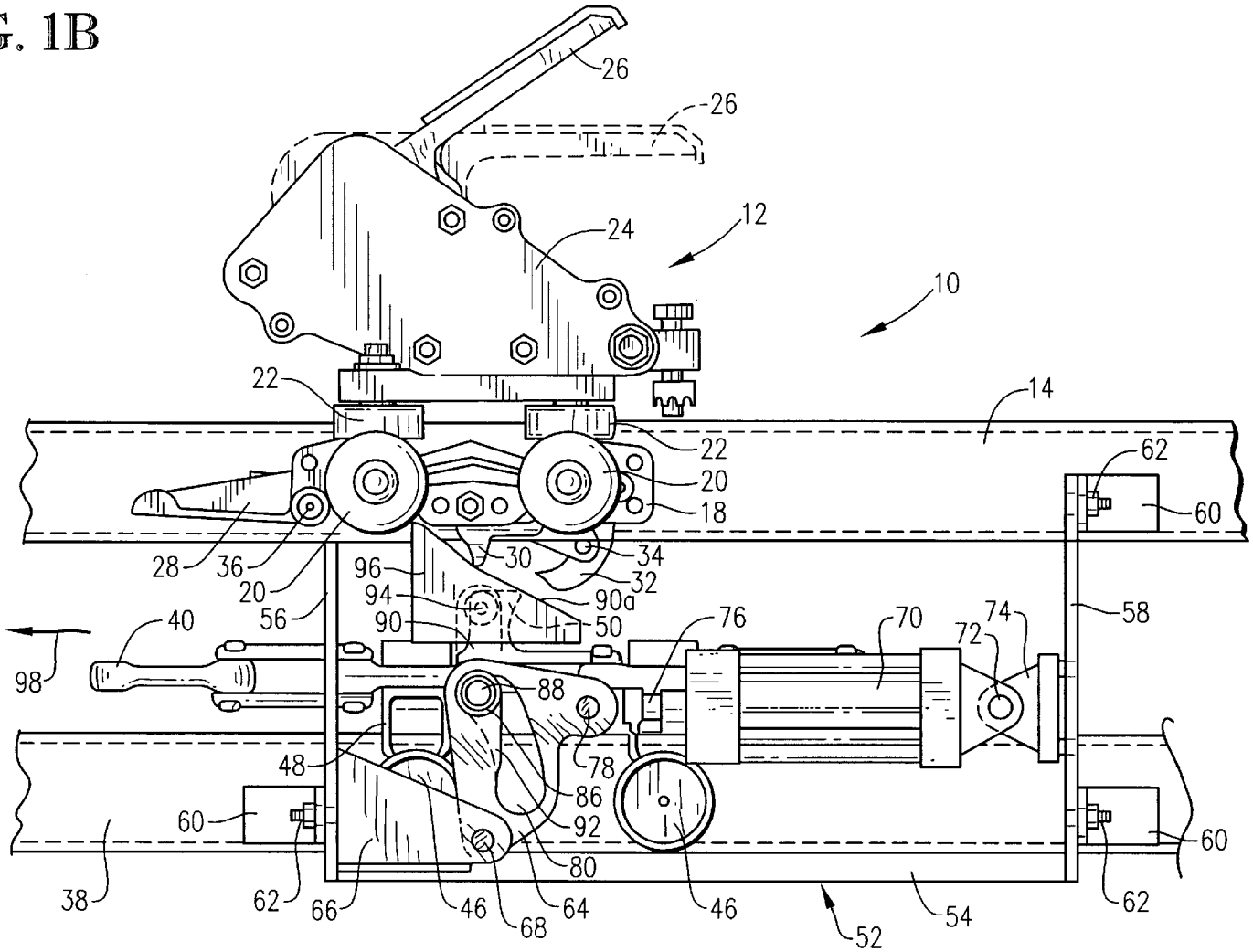
FIG. 1B is a fragmentary side elevational view similar to FIG. 1A, but showing the stop mechanism of the present invention actuated to detach a trolley of the conveyor system from the drive chain which normally conveys it along the conveyor track.
Figure 2:
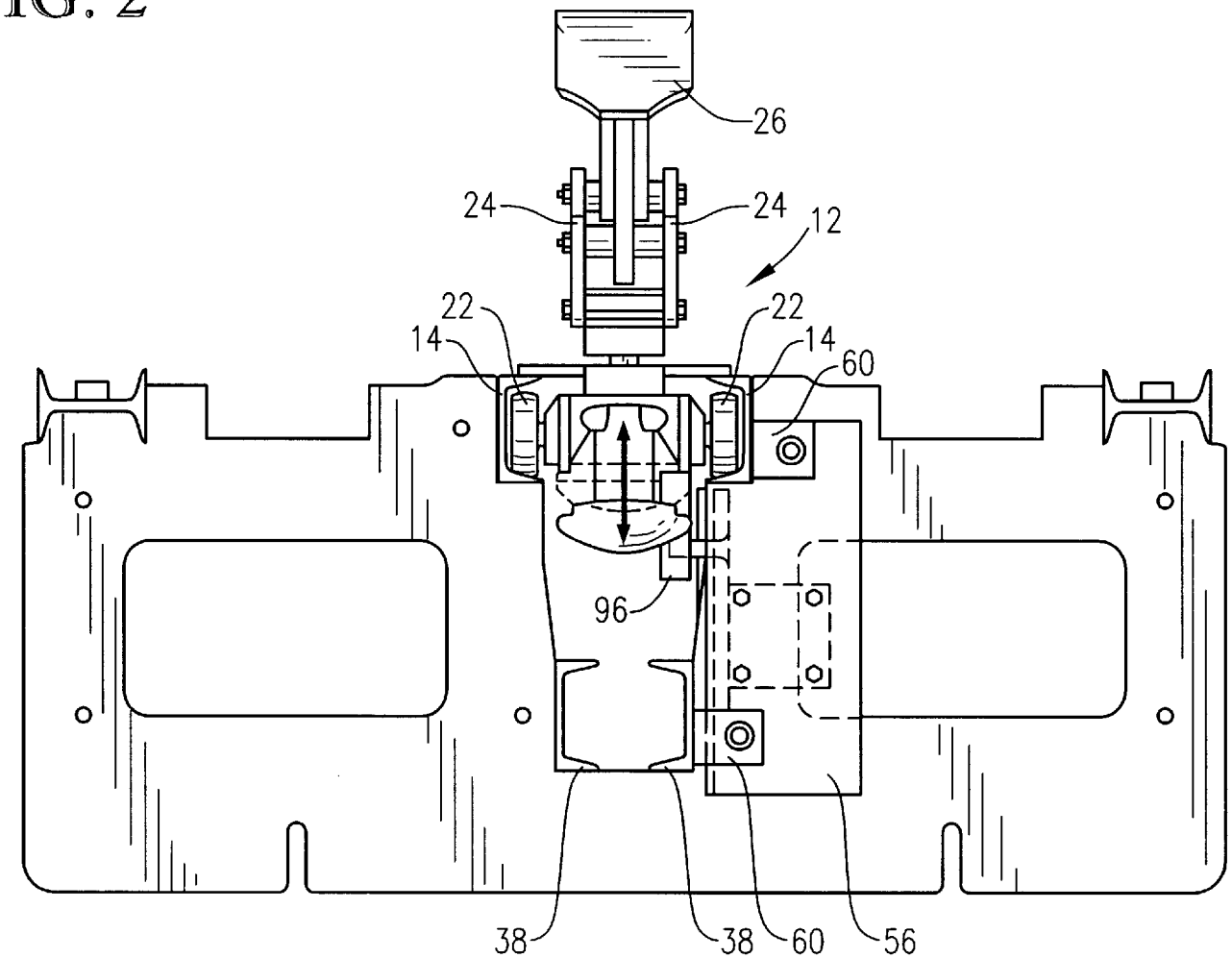
FIG. 2 is a fragmentary front elevational view of the trolley and related parts shown in FIGS. 1A and 1B.

The result is that the ramp 96 is moved upwardly to the fully raised position shown in FIG. 3B (and also in FIG. 1B). In this position, the cam roller 86 is seated on the shoulder 84 which is then located directly beneath the cam roller. This seating of roller 86 on shoulder 84 serves to lock the cam roller in place to prevent it from becoming displaced by the forces acting on it. As the trolley 12 approaches the raised ramp 96, the pivot arm 28 comes into contact with the inclined ramp surface 96*a*, and the inclined surface 30*a* of the trolley dog 30 rides upwardly along the ramp surface 96*a*. This causes the pivot arm 28 to pivot in a counterclockwise direction about the pivot pin 36, and the retractable trolley dog 30 is retracted upwardly far enough that it is disengaged from the chain drive dog 50. The drive dog 50 then passes beneath the trolley dog 30 and no longer provides driving action for the trolley 12. The trolley thus stops at the work station so that work can be performed on the article carried on its carrier.

It is noted that the chain 40 continues to travel and to convey other trolleys in the system along the conveyor tracks 14. Consequently, the remaining carriers can continue to be conveyed as desired.

When it is desired to move the trolley 12 away from the work station, the cylinder 70 is actuated to extend its piston rod 76. This pivots the cam plate 64 in a counterclockwise direction from the position of FIG. 3B to the position of 3A. The cam slot 80 progressively comes into registration with lower parts of the guide slot 92, and the cam roller 86 and the guide link 90 thus move downwardly until the position of FIG. 3A is reached. At this time, the ramp 96 is in its lowermost position, and the trailing portion of the pivot arm 28 moves downwardly under the influence of gravity to the position shown in FIG. 1A. Then, the next incoming chain dog 50 can engage the hold back dog 32 and pivot it upwardly so that the chain dog 50 can enter the space between dogs 30 and 32 and come into engagement with the trailing edge of the trolley dog 30. The chain then conveys the trolley 12 away from the work station and along the conveyor tracks 14.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A stop mechanism for a conveyor system having a trolley riding on a track and including a trolley dog normally engaged by a drive dog of a drive member to propel the trolley along the track, said stop mechanism comprising:

a frame;

a ramp member mounted on said frame for movement between a first position wherein an inclined ramp surface of said ramp member is positioned in the path of said trolley dog to engage the trolley dog and disengage it from said drive dog, and a second position wherein said trolley dog can pass said ramp member;

a cam plate mounted on said frame for pivotal movement, said cam plate having a cam slot therein;

a cam element received in said cam slot for movement therein when said cam plate is pivoted;

a power actuator connected to pivot said cam plate to effect movement of said cam element in said cam slot;

a connection between said cam element and ramp member effective to move said ramp member between the first and second positions thereof in response to movement of said cam element in said cam slot, a guide slot in the frame; and a guide member received in said guide slot for movement therein, said guide member being connected with said cam element for movement in the guide slot in response to movement of said cam element in the cam slot, said guide member being connected with said ramp member to effect movement thereof between said first and second positions in response to movement of said guide member in said guide slot.

2. A stop mechanism as set forth in claim 1, wherein said guide slot has a substantially vertical orientation and said ramp member has a substantially vertical and linear path of movement between the first and second positions thereof.

3. A stop mechanism as set forth in claim 2, wherein said guide member comprises a guide link having a lower end portion connected with said cam element and an upper end portion connected with said ramp member.

4. In a power and free conveyor system of the type having a track, a trolley riding on the track to convey workpieces along the track, a pivot arm on the trolley carrying a trolley dog, and a drive member carrying a drive dog normally engaged with the trolley dog for conveying the trolley, a stop mechanism comprising:

a frame;

a ramp member mounted on said frame for substantially vertical movement between first and second positions, said ramp member having an inclined ramp surface which is situated in the first position of the ramp member in the path of said trolley dog and oriented to effect pivoting of said pivot arm in a direction to disengage said trolley dog from said drive dog, said ramp member in the second position thereof being situated to allow movement of said trolley dog past said ramp member;

a cam plate mounted for pivotal movement on the frame and having a cam slot;

a substantially vertical guide slot in said frame located such that different portions of said cam slot and guide slot are aligned as the cam plate pivots;

a cam element received in said cam slot for movement therein;

a guide member received in said guide slot for movement therein and connected with said cam element such that the cam element and guide member occupy aligned portions of the cam slot and guide slot, respectively;

a connection between said guide member and ramp member effective to move the ramp member between said first and second positions as said guide member moves in said guide slot; and a power actuator connected to selectively pivot said cam plate.

* * * * *